US011371715B2

(12) United States Patent
Dankwardt et al.

(10) Patent No.: US 11,371,715 B2
(45) Date of Patent: Jun. 28, 2022

(54) COOKING APPLIANCE COMPRISING A LOWERABLE DOOR, WHICH HAS A SPECIFIC RETAINING SPRING FOR A BEARING BUSH

(71) Applicant: BSH Hausgeräte GmbH, Munich (DE)

(72) Inventors: Thomas Dankwardt, Karlsruhe (DE); Kerstin Sickert, Bretten (DE); Martin Brunner, Pforzheim (DE); Thorsten Rausch, Karlsruhe (DE)

(73) Assignee: BSH Hausgeräte GmbH, Munich (DE)

( * ) Notice: Subject to any disclaimer, the term of this patent is extended or adjusted under 35 U.S.C. 154(b) by 438 days.

(21) Appl. No.: 16/606,775

(22) PCT Filed: Jul. 9, 2018

(86) PCT No.: PCT/EP2018/068534

§ 371 (c)(1),
(2) Date: Oct. 21, 2019

(87) PCT Pub. No.: WO2019/020355

PCT Pub. Date: Jan. 31, 2019

(65) Prior Publication Data

US 2020/0378613 A1 Dec. 3, 2020

(30) Foreign Application Priority Data

Jul. 28, 2017 (DE) ..... 10 2017 213 095.4

(51) Int. Cl.
*F24C 15/02* (2006.01)
*F24C 15/04* (2006.01)

(52) U.S. Cl.
CPC ..... *F24C 15/026* (2013.01); *F24C 15/04* (2013.01); *F24C 15/023* (2013.01)

(58) Field of Classification Search
CPC ..... F24C 15/26; F24C 15/023; F24C 15/04; F24C 15/045
See application file for complete search history.

(56) References Cited

U.S. PATENT DOCUMENTS 2,925,081 A 2/1960 Shooter
3,127,889 A * 4/1964 Mills ..... F24C 15/023 126/194

(Continued)

FOREIGN PATENT DOCUMENTS

DE 1274306 B 8/1968
DE 20121929 U1 9/2003

(Continued)

OTHER PUBLICATIONS

International Search Report PCT/EP2018/068534 dated Oct. 4, 2018.
National Search Report DE 10 2017 213 095.4 dated Jul. 26, 2018.

*Primary Examiner* — Jorge A Pereiro
*Assistant Examiner* — Nikhil P Mashruwala
(74) *Attorney, Agent, or Firm* — Michael E. Tschupp; Andre Pallapies; Brandon G. Braun

(57) ABSTRACT

A cooking appliance includes a housing having a cooking chamber and a storage space, which is separate from the cooking chamber. A door is movably arranged on the housing for closing the cooking chamber and for lowering into the storage space in an opened state of the door. A handle is arranged in a fixed location on the door. Movably supported on the door is a guide element which is connected directly to a first end of a retaining spring on the door so as to maintain a coupling position of the guide element on the door. A guide track is mounted in the storage space for guiding the guide element on the door.

13 Claims, 5 Drawing Sheets

(56) References Cited

U.S. PATENT DOCUMENTS

| | | | | | |
|---|---|---|---|---|---|
| 3,838,538 | A * | 10/1974 | Burford | F24C 15/023 | 126/194 |
| 4,704,870 | A * | 11/1987 | Beitner | H01L 35/30 | 62/3.62 |
| 6,397,836 | B1 * | 6/2002 | Pelletier | F23M 7/02 | 49/386 |
| 7,255,101 | B2 * | 8/2007 | Grutzke | E05D 15/582 | 312/109 |
| 7,261,100 | B2 * | 8/2007 | Bartmann | F24C 15/026 | 126/192 |
| 8,047,198 | B2 * | 11/2011 | Meyer | F24C 15/026 | 49/113 |
| 9,121,211 | B1 * | 9/2015 | White | E05F 5/02 | |
| 9,574,778 | B2 * | 2/2017 | Woods | F24C 15/026 | |
| 10,408,465 | B2 * | 9/2019 | Grobleben | E05D 15/582 | |
| 10,948,195 | B2 * | 3/2021 | Grobleben | E05D 15/582 | |
| 2005/0034381 | A1 | 2/2005 | Bailmann et al. | | |
| 2018/0038145 | A1 | 2/2018 | Bleier et al. | | |
| 2020/0408421 | A1 * | 12/2020 | Johnson | F24C 15/028 | |

FOREIGN PATENT DOCUMENTS

| | | | |
|---|---|---|---|
| DE | 102007041891 | A1 | 3/2009 |
| DE | 102011078535 | A1 | 1/2013 |
| DE | 102011086970 | A1 | 5/2013 |
| DE | 102016215651 | A1 | 2/2018 |

* cited by examiner

COOKING APPLIANCE COMPRISING A LOWERABLE DOOR, WHICH HAS A SPECIFIC RETAINING SPRING FOR A BEARING BUSH

CROSS-REFERENCES TO RELATED APPLICATIONS

This application is the U.S. National Stage of International Application No. PCT/EP2018/068534, filed Jul. 9, 2018, which designated the United States and has been published as International Publication No. WO 2019/020355 A1 and which claims the priority of German Patent Application, Serial No. 10 2017 213 095.4, filed Jul. 28, 2017, pursuant to 35 U.S.C. 119(a)-(d).

BACKGROUND OF THE INVENTION

The invention relates to a cooking appliance with a housing, in which a cooking chamber is configured. The cooking appliance has a door for closing the cooking chamber. The door is arranged in a movable manner on the housing. A handle is arranged in a fixed location and therefore unmovably on the door. The cooking appliance has a storage space, which is separate from the cooking chamber and configured in the housing, in which the door can be lowered in its opened state. The storage space has at least one guide track, in which a guide element of the door is guided.

It is known with cooking appliances that a door for closing a cooking chamber is arranged in a lowered manner in such a storage space in the opened state. This is a space-saving design, allowing unrestricted and easy access to the cooking chamber at the front. In contrast to a fold-out door, which is only arranged pivotably on the housing, such a lowerable door makes it possible to move very close to the cooking chamber in the opened state. This makes it easy to place items in or take them out of the cooking chamber. It also minimizes contact with an opened door, also preventing a user being affected by the heat thereof in an unwanted manner.

Such lowerable doors for cooking appliances are known from the prior art. It is also known here that such doors can also have a handle, which is arranged in a movable manner on the door itself. This is done in such a manner that, when the door is pivoted and lowered into the storage space, the handle is also pivoted relative to a door leaf on which the handle is arranged. This means that in the fully opened state, in which the door leaf is essentially oriented in a horizontal plane, the door handle is pivoted in such a manner that it can be grasped from the front. Relatively complex mechanical devices have to be configured to allow such additional handle pivotability. This takes up more space and increases the weight of the door.

In order to counteract this, in alternative embodiments provision can be made for said handle to be arranged on the door leaf in a fixed location and therefore unmovably. This means that when the door and therefore also the door leaf is pivoted, the handle itself is not pivoted. Such a design is known for example from DE 1 274 306. One disadvantage of this design is that the door is incorporated in a fixed manner and cannot be easily removed. This is a problem for maintenance and cleaning.

BRIEF SUMMARY OF THE INVENTION

It is the object of the present invention to create a cooking appliance, which has a door that can be lowered into a storage space with a handle arranged in a fixed location on a door leaf, the operability of the door as a separate component being facilitated in this manner.

According to one aspect of the invention a cooking appliance is provided with a housing, in which a cooking chamber is configured. The cooking appliance has a door for closing the cooking chamber. Said door is arranged in a movable manner on the housing. A handle is arranged in a fixed location and therefore unmovably on the door. This means in particular that, when the door is moved, the handle does not perform a movement relative to the door leaf, on which the handle is arranged. The cooking appliance also has a storage space, which is separate from the cooking chamber and configured in the housing, into which the door can be lowered in the opened state. The storage space has at least one guide track, in which a guide element of the door is guided. This means in particular that the movement of the door into the storage space and out of the storage space is predefined very specifically, so that it can take place smoothly and very easily, without jamming.

The guide element is supported movably on the door and connected directly to a first end of a retaining spring on the door. This retaining spring maintains a coupling position of the guide element on the door. Such a design easily allows the door to be removed from the housing and mounted back again in a non-destructively reversible manner as well as easily and quickly. In order to be able to carry this out easily and reliably, it is necessary to define the coupling position of the guide element. As said guide element is however also to be supported movably, said coupling position has to be defined in order to mount the door on the housing. In order not to displace said coupling position or essentially not be able to find it due to the movable support, said coupling position is maintained using the specific retaining element, specifically in particular the retaining spring. The retaining spring is a particularly advantageous part for this, on the one hand as said coupling position is reliably maintained and on the other hand there is a very continuous capacity for movement of said guide element also defined by the spring. The retaining spring also allows said coupling position to be reached again automatically having been left after mounting, as the retaining spring automatically resets the coupling position as a result of the pretensioning that results during removal. The specific connection of the spring also provides a mechanically stable coupling mechanism with minimal parts.

Provision is preferably made for the door to have a retaining bracket for holding a door panel of the door. A second end of the retaining spring is connected directly to said retaining bracket. This is also a mechanically stable design with few parts. The retaining bracket, which is then present anyway, is also a multifunctional part, which is configured to hold the door panel on the one hand and to hold the second end of the retaining spring on the other hand.

The first end of the retaining spring is preferably configured as a hook and arranged so that it engages in a passage into a radial web of the guide element. This allows a particularly reliable and simple mechanical coupling of the retaining spring directly to the guide element.

The retaining spring is in particular a spiral spring.

In one advantageous embodiment the passage is configured as a keyhole-type geometry. On the one hand this allows said first end of the retaining spring to be fed into the passage very easily and accurately. On the other hand it also means that in the end position, in which said first end is suspended in the tapered part of the keyhole geometry, there is as little play and therefore movement tolerance as possible for said first end. This prevents unwanted slipping and noise from the spring when the door is moved. In particular it prevents the retaining spring popping out in an unwanted manner in such movement scenarios.

Provision is preferably made for a damping element for damping any friction noise between the retaining spring and the passage to be arranged on a boundary wall of the passage. On the one hand this allows effortless movement and in particular means that the retaining spring is particularly advantageously supported in manner that in particular generates less noise.

In a further exemplary embodiment provision is made for the retaining spring to be enclosed by a tube-like sleeve. This sleeve is a noise-reducing element in particular. Noise resulting as the retaining spring is tensioned and detensioned is at least significantly damped by said sleeve, so that no unwanted noise can be heard outside or is perceived as undesirably loud. This tube-like sleeve is preferably configured as elastically deformable and can be a tube made of elastomer for example.

Provision can be made for the length of said sleeve, which is measured in the direction of its longitudinal axis, to correspond to the length corresponding to the opening region or axial elongation of the spiral windings of the retaining spring, when the spring is in the untensioned state. This means that when the spring is tensioned and therefore extended, said region with the spiral windings becomes longer than the length of said sleeve. On the one hand this means that the capacity for movement of the retaining spring is not restricted; on the other hand this sleeve length is enough to reduce noise sufficiently.

In a further embodiment provision can however also be made for the length of the sleeve to be greater. This can be advantageous in particular if the sleeve is not configured to be of rigid length but to be of variable length. With such an embodiment the sleeve can be configured in the manner of bellows for example. Such a design also allows said sleeve to undergo the length change of the spiral spring region of the retaining spring at the same time.

In one advantageous embodiment the guide element is configured as a bearing bush. When designed as a bearing bush it is coupled in particular directly to boundary elements of the guide track. Provision can therefore be made for the bearing bush to have a guide channel, in which a guide wall or guide runner of the guide track engages. The bush design is also configured in particular in such a manner that a hollow region is formed, allowing said bearing bush to be positioned for example on a coupling element such as a coupling rod. Said holder is configured in particular as a blind hole. The bearing bush is therefore not a pipe-like part in particular but is closed at one end face.

In one advantageous embodiment provision is made for the guide element to have an integrated adjusting pin, the actuation of which can bring about the release of a mounted state of the door from a holder arranged on the guide track. It is this adjusting pin that has to be held in the mounting position, in particular by the retaining spring, to allow the door to be mounted on the housing. After mounting, said adjusting pin is in a retaining position that is different from its mounting position, thereby preventing the unwanted release or autonomous dropping of the door from the housing. The adjusting pin is arranged at the end of the guide element and oriented so that it overhangs freely.

Provision is preferably made for the adjusting pin to be configured in the manner of a bar and to be arranged with its longitudinal axis at an angle between 20° and 60° to a vertical axis of the door in the coupling position or mounting position. This specific coupling position or mounting position allows easy, fast and reliable attachment of the door to the housing and the mounting operations or mounting movements to be completed easily and intuitively. This allows the door to be mounted easily, quickly and reliably on the housing.

Provision is preferably made for the door to have an upper, hood-like cover strip. This cover strip is a separate part and can also be referred to as a top facing. The cover strip is in particular configured as a single piece, in particular made of plastic.

In a further advantageous embodiment the door has a set of panels, having at least a front panel and an inner panel. The front panel is the outermost panel of said set of panels facing away from the cooking chamber. In particular such a front panel is configured in such a manner that it covers the front of the cover strip referred to above in the mounted state. The surface dimension and position of said front panel are therefore selected in such a manner that said cover strip, which is behind it when viewed in the depthwise direction of the cooking appliance, is concealed at the front. This also protects said cover strip and gives the door a harmonious appearance from the front.

Provision can also be made in one embodiment for the cover strip not to be covered by the front panel at the front.

In a further advantageous embodiment provision is made for the cover strip to have a separate reinforcing part to reinforce the cover strip. This is advantageous in that, in the case of a cooking appliance with a self-cleaning mode, it prevents unwanted deformation of this cover element, or cover strip, which is made in particular of plastic, in said self-cleaning mode. If a user pulls the door with a relatively high level of force in such a self-cleaning mode, it can result in unwanted deformation of said cover strip but this is avoided by said at least one additional reinforcing part. The reinforcing part can be arranged on the front panel and the cover strip can then be pushed or positioned thereon. Provision is also made here in particular for screwing to the front panel.

In one advantageous embodiment provision is made for said reinforcing part also to have the function of a locking element, which locks the door in its closed position when the cooking appliance is in self-cleaning mode.

At least one stop is preferably arranged in the storage space, to limit the insertion depth of the door into said storage space in such a manner that the handle is at a distance from a front face of the cooking appliance when the door is in its maximum insertion position. Provision is made in particular for said distance between a front face of the housing and an upper edge of the door, which does not have to be the same as the upper edge of the handle, as the handle can also be arranged at a distance downward from the upper edge of the door, to be between 80 mm and 90 mm, in particular 85 mm, in this maximum insertion position.

In one advantageous embodiment provision is made for the door to be configured in such a manner that different front panels of the set of panels mentioned above can be mounted. Glass of different colors can be used in particular so that different variants can be formed for the visual appearance at the front. A uniform visual appearance at the front can be configured with an optionally additional switch panel or operating panel of the cooking appliance which is preferably arranged adjacent to the door.

It is also possible for a cover strip with at least two different variants to be mounted on the door. A cover strip for a cooking appliance with a self-cleaning mode can be provided. A different cover strip can also be provided, which is suitable for a cooking appliance without self-cleaning mode. In particular identical parts are provided here, allowing such attachment of cover strip variants.

The handle of the door is preferably fastened, in particular screwed, to the front panel. To this end the front panel preferably has two guides or holes, through which the screws can be passed. Provision is preferably made for the reinforcing part, which can be arranged on the cover strip to reinforce it, also to be screwed to the front panel. Provision can be made in particular for screwing to take place by way of the same screw hole to which the handle is also screwed. This means that retaining points are limited locally and the number of passages or screw holes in the front panel is minimized.

In one embodiment provision can be made for the guide element to be configured as a single piece. The guide element can preferably be made of plastic.

The terms "top", "bottom", "front", "rear", "horizontal", "vertical", "depthwise direction", "widthwise direction", "heightwise direction", etc. refer to the positions and orientations resulting when the appliance is used and arranged in the correct manner.

Further features of the invention will emerge from the claims, figures and description of the figures. The features and feature combinations cited above in the description as well as the features and feature combinations cited in the following in the description of the figures and/or shown in the figures alone can be used not only in the respectively cited combination but also in other combinations, without departing from the scope of the invention. Therefore embodiments of the invention which are not specifically described and illustrated in the figures but will emerge and can be generated from the described embodiments as a result of separate feature combinations are also deemed to be covered and disclosed by the invention. Embodiments and feature combinations which do not therefore have all the features of an originally formulated independent claim should also be deemed to be disclosed. Embodiments and feature combinations, which go beyond or deviate from the feature combinations set out in the claim references, should also be deemed to be disclosed, in particular as a result of the embodiments set out above.

BRIEF DESCRIPTION OF THE DRAWINGS

Exemplary embodiments of the invention are described in more detail below with reference to schematic drawings, in which.

DETAILED DESCRIPTION OF EXEMPLARY EMBODIMENTS OF THE PRESENT INVENTION

Figure 1:
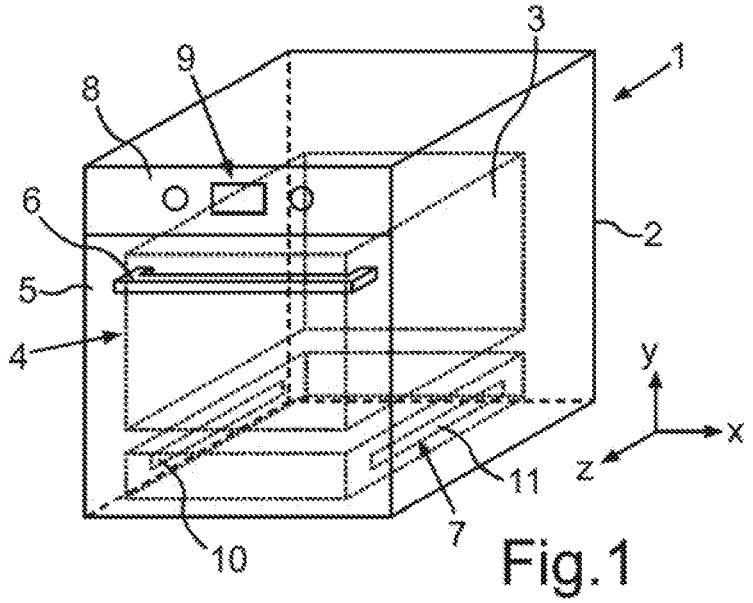
FIG. 1 shows a perspective view of an exemplary embodiment of an inventive cooking appliance.

Identical elements or those of identical function are shown with the same reference characters in the figures.

FIG. 1 shows a cooking appliance 1, which can be for example an oven or a microwave cooking appliance or a steam cooking appliance or a combination of the cited appliances. The cooking appliance 1 has a housing 2, in which a cooking chamber 3 for cooking food is configured. The cooking appliance 1 also has a door 4, which is configured to close the cooking chamber 3 at the front. The door 4 has a door leaf 5, which is configured as a plate-like part. A handle 6 is arranged on the front of the door leaf 5, therefore facing away from the cooking chamber 3. Said handle 6 is arranged, in particular screwed, in a fixed location and therefore unmovably on the door leaf 5. The door 4 is shown in the closed state in FIG. 1. In this design the door leaf 5 is oriented in a vertical plane, specifically the x-y plane.

The cooking appliance 1 also has a storage space 7, which is configured separately from the cooking chamber 3 and is configured below the cooking chamber 3 in the housing 2 in the heightwise direction (y-direction). In the opened state the door 4 can be inserted or lowered into said storage space 7. The position of the handle 6 on the door leaf 5 does not change relative to the door leaf 5, even when the door 4 is moved.

In the exemplary embodiment the cooking appliance 1 also has an operating panel 8, on which an operating and/or display apparatus 9 is preferably configured.

The storage space 7 is delimited by walls, with two opposing side walls in particular each having a guide track 10 and 11, in which guide elements of the door 4 are guided.

Figure 2:
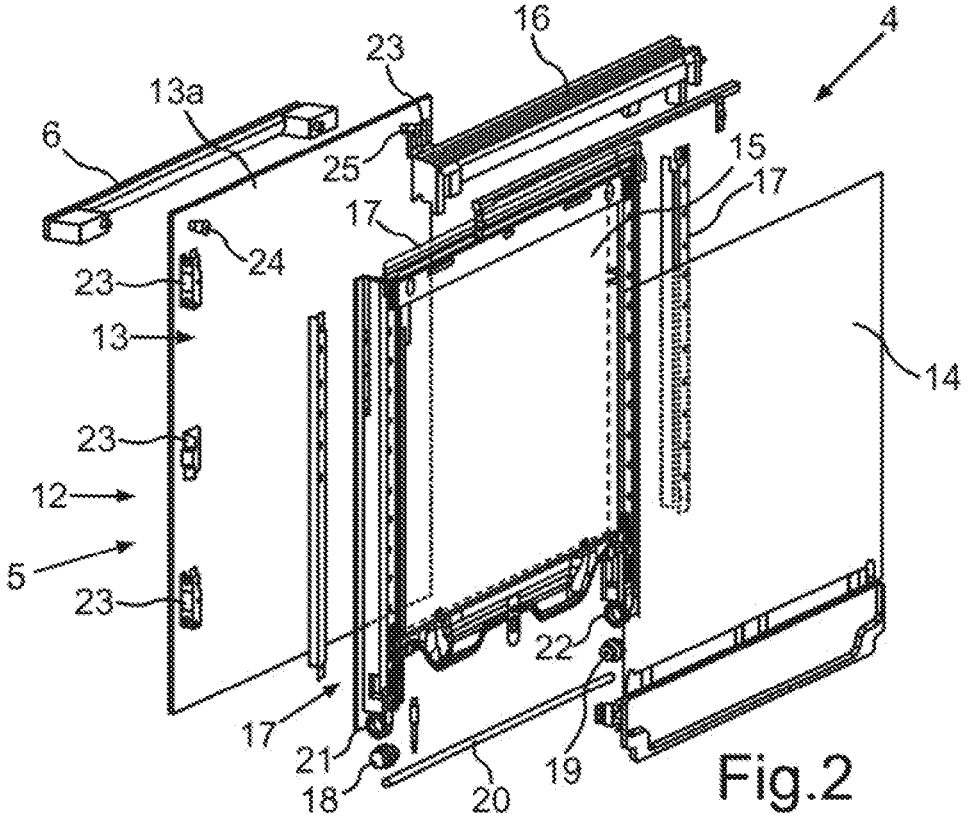
FIG. 2 shows an exploded view of an exemplary embodiment of the door.

FIG. 2 shows an exploded view of an exemplary embodiment of the door 4. Provision is made for the plate-like door leaf 5 to have a set of panels 12, the set of panels 12 having a front panel 13, an inner panel 14 and here in particular also an intermediate panel 15. These three panels 13 to 15 are in particular arranged parallel and at a distance from one another. The door 4 also has a cover strip 16, which is configured as a hood or top facing positioned on top. Said cover strip 16 is preferably configured as a single piece and is in particular made of plastic. It covers the door leaf 5 from above.

The door 4 also has a frame 17, which is configured here from multiple parts, the set of panels 12 being held thereon.

The door 4 also has the abovementioned guide elements, configured here as bearing bushes 18, 19. The two bearing bushes in the present exemplary embodiment are positioned at opposing ends in the widthwise direction of the door, preferably being connected by a connecting rod 20. The narrow sides of the bearing bushes 18 and 19 are pushed onto said connecting rod 20. One of the bearing bushes 18 and 19 respectively is then arranged so that it engages in the guide tracks 10, 11 so that the lowering movement or outward movement of the door 4 into or out of the storage space 7 is guided and therefore particularly smooth and impact-free.

The bearing bushes 18 and 19 are also held by holes 21 and 22, which are configured in frame parts or frame profiles of the frame 17.

It is also shown that a plurality of retaining brackets 23 or adhesive brackets are arranged on an inner face 13*a* of the front panel 13.

It is also shown that two passages 24 and 25 are configured here as screw holes in the front panel 13, it being possible for screws to be passed through them to fasten the handle 6 in particular in a fixed location on the front panel 13.

As shown in FIG. 1 and FIG. 2, the front panel 13 is of such a height (extension in y-direction) that the cover strip 16 is covered, in particular completely covered, by said front panel 13 when the door 4 is viewed from the front.

Figure 3:
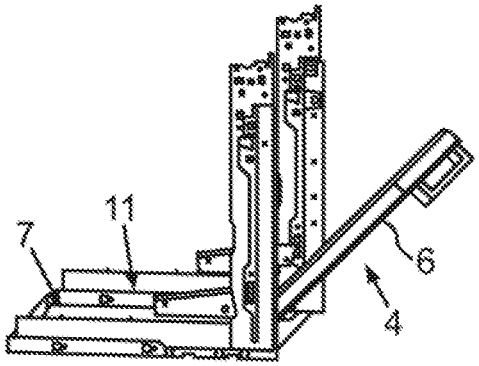
FIG. 3 shows a diagram of subcomponents of the cooking appliance according to FIG. 1 with the door partially opened.

FIG. 3 shows subcomponents of the cooking appliance 1, the door 4 here being shown in the partially opened state, in which it has not yet been moved into the storage space 7.

Figure 4:
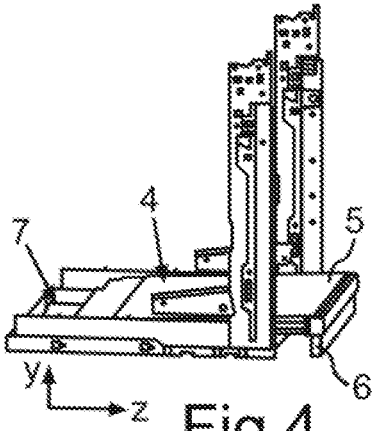
FIG. 4 shows a diagram of the components according to FIG. 3 with the door fully opened and inserted into a storage space.

FIG. 4 shows a diagram, in which said door 4 is fully opened and lowered into the storage space 7.

Figure 5:
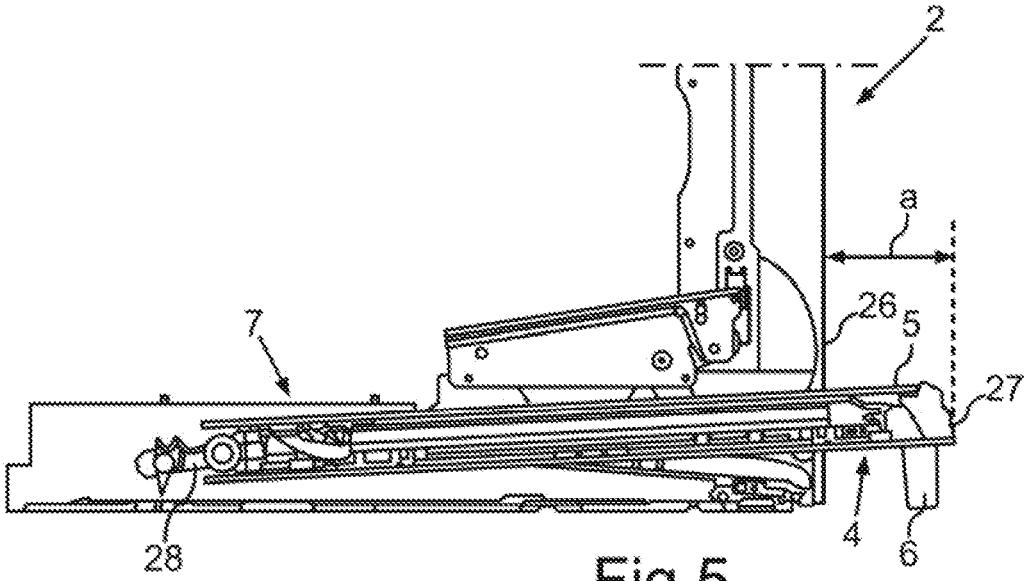
FIG. 5 shows a side view of the diagram according to FIG. 4.

As shown already in FIG. 4, the door 4 and in particular the door leaf 5 however project forward out of the storage space 7 by a specific length in this maximum insertion position. The maximum insertion depth of the door 4 and in particular of the door leaf 5 in this end position is such that there is a distance a between 80 mm and 90 mm, in particular 85 mm, between a front face 26 of the housing 2 and an upper edge 27 of the door 4, in particular of the door leaf 5. This maximum insertion depth and therefore the distance a are selected in such a manner that the handle 6 is positioned at a distance from the front face 26 in said depthwise direction so that it can be grasped from behind by a hand, as shown in FIG. 5. It is also shown in FIG. 5 that a stop 28 is arranged in the storage space 7 to limit said maximum insertion depth of the door 4.

Figure 6:
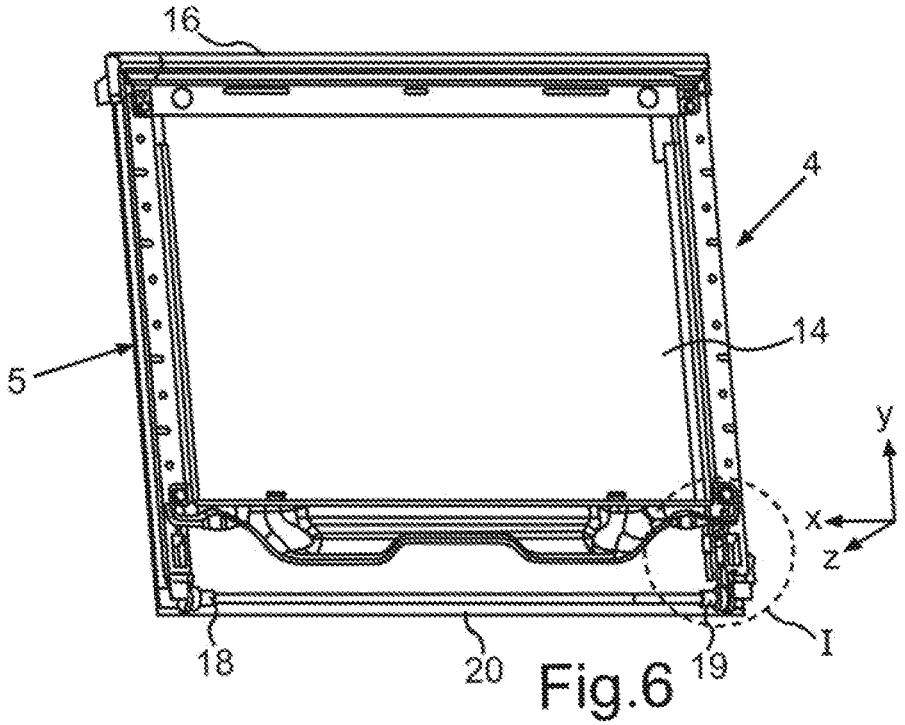
FIG. 6 shows a perspective view of the door according to FIG. 2 in the assembled state.

FIG. 6 shows the door 4 in the assembled state. The door 4 is shown here looking toward the inner panel 14.

The bearing bushes 18 and 19 are arranged movably on the door 4, so that they can rotate about the axis which is oriented in the widthwise direction (x-direction) and defined in particular by the connecting rod 20. A movement relative to the door leaf 5 is therefore possible here.

When a specific coupling position, or mounting position, of the bearing bushes 18 and 19 has been set, the door 4 can be mounted on the housing 2. This coupling position of the bearing bushes 18, 19, which is a specific rotation position about said rotation axis, must however be set first and specifically maintained.

Figure 7:
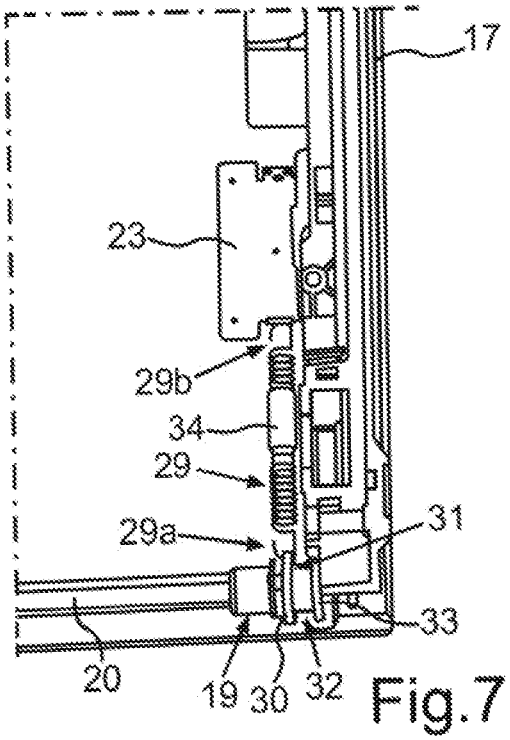
FIG. 7 shows an enlarged view of a partial detail of the door according to FIG. 6.

To this end the door 4, as shown more clearly in an enlarged view in FIG. 7, has a retaining spring 29. The enlarged region I of FIG. 6 shown in FIG. 7 shows that a first end 29*a* of said retaining spring 29, which is bent in the manner of a hook, is connected directly to the bearing bush 19.

In the embodiment shown here the bearing bush 19 has a radial web 30, which has a passage 31 in the form of a hole, through which said first end 29*a* is passed and suspended. Said radial web 30 also delimits a channel 32. The channel 32 is also delimited by a further radial web 33. Said channel 32 defines a coupling to a guide runner of the guide track 11, said guide runner engaging in the channel 32.

A second end 29*b*, opposite the opposing first end 29*a*, of the retaining spring 29, which is in particular a spiral spring, is suspended directly from a retaining bracket 23, which is provided to hold the front panel 13 and bonded to said front panel 13.

The door 4 also has a tube-like sleeve 34, which encloses the retaining spring 29. Said sleeve 34 has a length in the axial direction, which corresponds to the region of the retaining spring 29 with the spiral windings, when the retaining spring 29 is in the detensioned state. FIG. 7 in contrast shows the tensioned state, in which said windings are pulled apart. As a result only a sub region of said spiral windings is enclosed by said tube-like sleeve 34. The tube-like sleeve 34 is a noise-reducing element. It can be made of an elastic material, for example elastomer.

The retaining spring 29 holds the coupling position, as mentioned above, of the guide element 29 in position. Said retaining spring 29 also allows said coupling position to be reset automatically after the door 4 has been removed from the housing 2 when the bearing bush 19 is pivoted out of said coupling position in the mounted state.

In a further embodiment according to FIG. 7 provision can also be made for said sleeve 34 not to be configured of stable length but of variable length and to be a bellows for example. With such a design said sleeve 34 can then undergo the change of length of the spiral region of the retaining spring 29 at the same time, so that the spiral winding region is in particular also completely enclosed by the sleeve 34 when the retaining spring 29 is in the tensioned state.

The door 4 is preferably configured correspondingly on the opposing side in the bearing bush 18.

Figure 8:
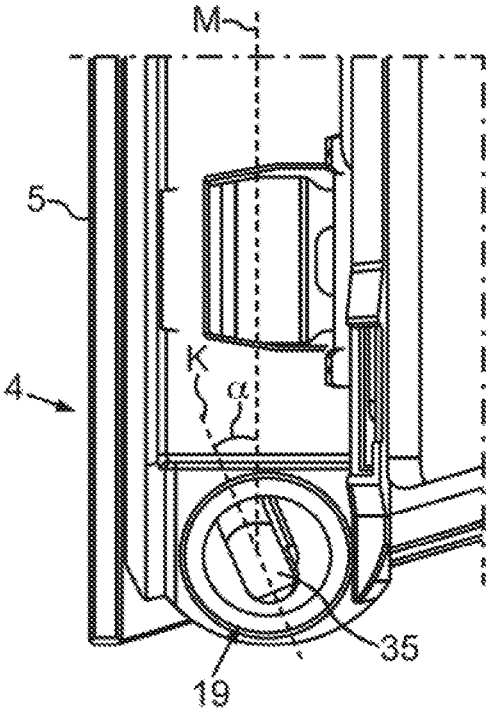
FIG. 8 shows a partial view of a side region of the door according to FIG. 6 and FIG. 7.

FIG. 8 shows an enlarged side view of the door 4, looking here at an outer end of the bearing bush 19. As shown here, said bearing bush 19 has an integrated adjusting pin 35, which is configured in the manner of a bar and oriented to overhang freely or laterally freely. The door leaf 5 has a vertical axis H, which is oriented in the heightwise direction when the door 4 is in the closed state. In contrast said bar-like adjusting pin 35 is arranged with a longitudinal axis K at an angle, possibly at an angle $\alpha$ between 10° and 40°, in particular between 10° and 30°, thereto. FIG. 8 shows the coupling position of the bearing bush 19 and therefore also of the adjusting pin 35, as mentioned above.

Figure 9:
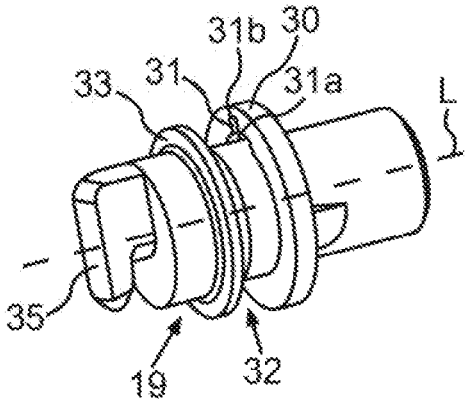
FIG. 9 shows a perspective view of an exemplary embodiment of a guide element of the door configured as a bearing bush.

FIG. 9 shows an enlarged view of an exemplary embodiment of the bearing bush 19. It can also be seen here that the passage 31 has the shape of a keyhole or the nature of a keyhole geometry. As shown here, a region 31*a* facing the longitudinal axis L of said bearing bush 19 is widened to allow easy insertion of the end 29*a*. A further region 31*b* of said passage 31, which is at a radial distance therefrom and therefore further out from the longitudinal axis L is tapered in contrast. In the finally mounted state the hook-shaped end 29*a* is supported in this tapered region 31*b*. Provision can be made for boundary walls of said passage 31 to be covered with a noise-reduced material, for example a sealing element or a corresponding coating. Said suspension loop for example can also be sheathed in plastic or a sealing ring can be arranged on said boundary wall.

Figure 10:
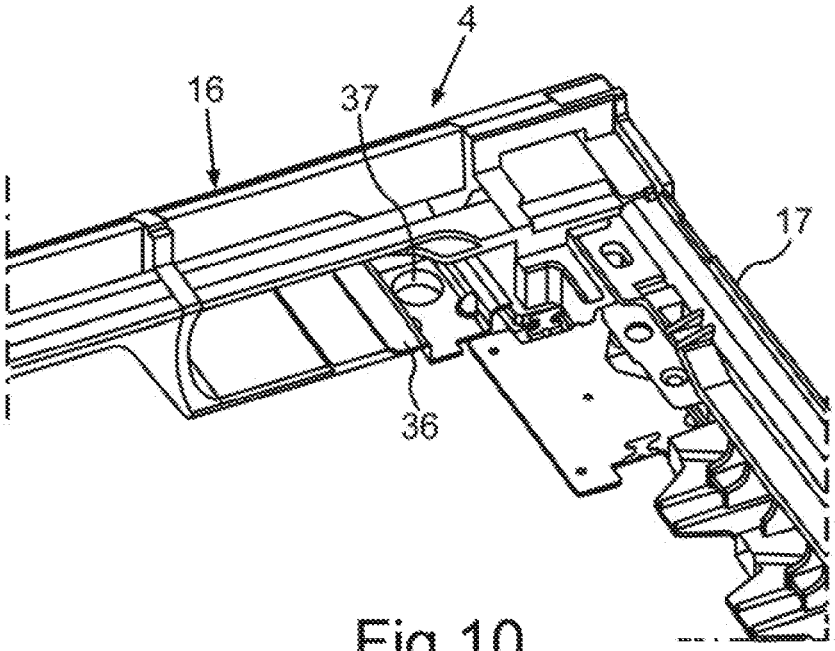
FIG. 10 shows a perspective view of a sub region of the door.

FIG. 10 shows a perspective view of a further detail of the door 4, an upper corner region being shown with the cover strip 16 here. A separate reinforcing element 36 can be arranged on, in particular attached to, said cover strip 16. This reinforcing part 36 can be made of metal. It serves in particular, when the cooking appliance 1 is in self-cleaning mode, to reinforce the cover strip 16 made of plastic, so that this is not deformed in an unwanted manner, particularly when it is pulled. Said reinforcing part 36 is preferably screwed to the front panel 13, a passage 37 being provided here for a screw. The passage 37 is then in particular congruent with the passage 25, so that the same screw connection as for the handle 6 is also provided for said reinforcing part 36. The reinforcing part 36 can also serve as a locking element for locking the door 4 in self-cleaning mode.

Figure 11:
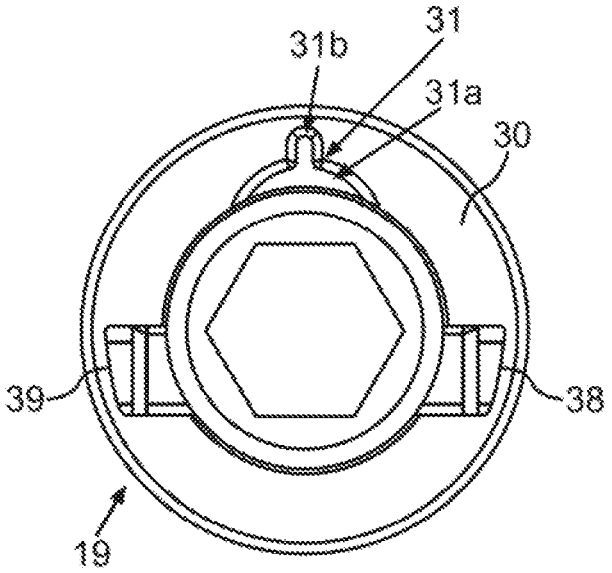
FIG. 11 shows a side view of the bearing bush according to FIG. 9.
Figure 12:
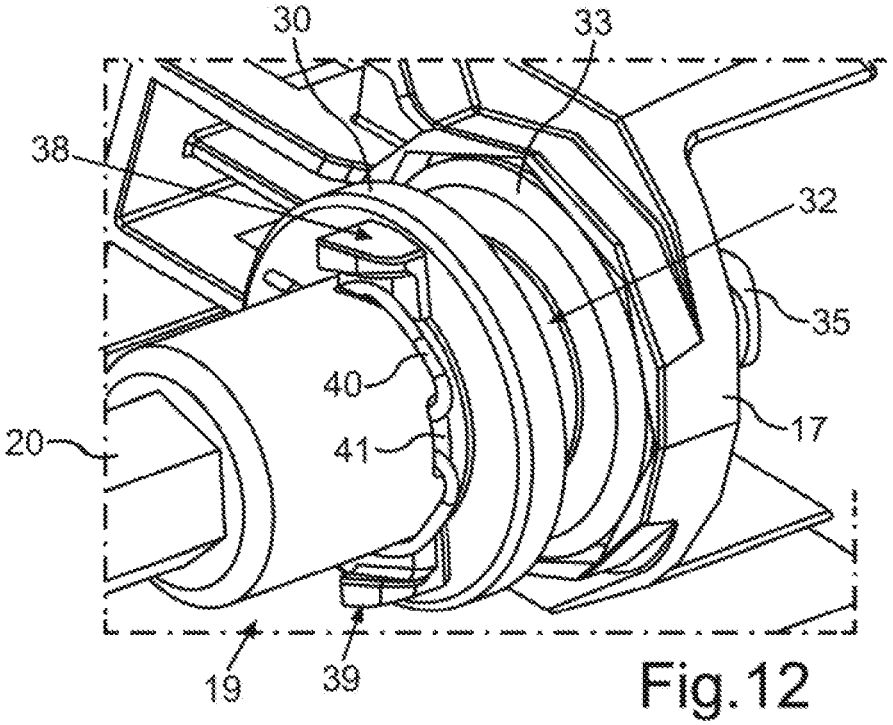
FIG. 12 shows a perspective view with the bearing bush and further components.

FIG. 11 shows a side view of the bearing bush 19. The geometry of the passage 31 is shown in more detail here. Also wing-type stops 38, 39 are formed in this example, being arranged with an axial orientation and radially at a distance from a base pipe of the bearing bush 19. Said stops 38, 39 prevent a securing spring 40, which secures the position of the bearing bush 19 on the connecting rod 20, from popping out. The securing spring 40 is shown in a perspective view in FIG. 12. A stirrup region of the securing spring 40 configured as a wire spring engages in an opening 41 in the base pipe of the bearing bush 19. Said stirrup region engages through the wall of the base pipe to couple mechanically to the connecting rod 20 and secure the position.

The invention claimed is:

1. A cooking appliance, comprising:

housing having a cooking chamber and a storage space, which is separate from the cooking chamber;

a door movably arranged on the housing for closing the cooking chamber and for lowering into the storage space in an opened state of the door;

a retaining spring mounted to the door;

a guide element movably supported on the door and connected directly to a first end of the retaining spring on the door so as to maintain a coupling position of the guide element on the door;

a guide track mounted in the storage space for guiding the guide element on the door; and a handle arranged in a fixed location on the door, wherein the guide element has a radial web formed with a passage, said first end of the retaining spring being configured as a hook and engaging in the passage of the radial web of the guide element.

2. The cooking appliance of claim 1, further comprising a retaining bracket mounted to the door for accepting a door panel of the door, said retaining spring having a second end which is connected directly to the retaining bracket.

3. The cooking appliance of claim 1, wherein the passage has a keyhole geometry.

4. The cooking appliance of claim 1, further comprising a damping element arranged on a boundary wall of the passage for damping friction noise from the retaining spring.

5. The cooking appliance of claim 1, further comprising a tube-like sleeve configured to enclose the retaining spring.

6. The cooking appliance of claim 1, wherein the guide element is a bearing bush.

7. The cooking appliance of claim 1, wherein the guide element has an integrated adjusting pin configured to release a mounted state of the door on the guide track when actuated.

8. The cooking appliance of claim 7, wherein the adjusting pin is configured in the manner of a bar and defines a longitudinal axis which extends at an angle between 10° and 40° to a vertical axis of the door in the coupling position.

9. The cooking appliance of claim 1, further comprising an upper cover strip placed upon the door.

10. The cooking appliance of claim 9, wherein the door has a door panel in the form of a front panel, said door panel configured to cover a front of the cover strip.

11. The cooking appliance of claim 9, wherein the door has a reinforcing part arranged on the cover strip to reinforce the cover strip.

12. The cooking appliance of claim 1, further comprising a stop arranged in the storage space to limit an insertion depth of the door in such a manner that the handle is arranged at a distance from a front face of the housing when the door assumes a maximum insertion position.

13. The cooking appliance of claim 1, further comprising a stop arranged in the storage space to limit an insertion depth of the door in such a manner that an upper edge of the door is arranged at a distance of between 80 mm and 90 mm from a front face of the housing when the door assumes a maximum insertion position.

* * * * *